US009013115B2

(12) United States Patent
Kawabata et al.

(10) Patent No.: US 9,013,115 B2
(45) Date of Patent: Apr. 21, 2015

(54) DISCHARGE LAMP IGNITING APPARATUS

(71) Applicant: Sansha Electric Manufacturing Company, Limited, Osaka-shi, Osaka-fu (JP)

(72) Inventors: Tatsuya Kawabata, Osaka (JP); Hiroki Morimoto, Osaka (JP)

(73) Assignee: Sansha Electric Manufacturing Company, Limited, Osaka-Fu (JP)

( * ) Notice: Subject to any disclaimer, the term of this patent is extended or adjusted under 35 U.S.C. 154(b) by 0 days.

(21) Appl. No.: 14/034,047

(22) Filed: Sep. 23, 2013

(65) Prior Publication Data

US 2014/0246977 A1 Sep. 4, 2014

(30) Foreign Application Priority Data

Mar. 1, 2013 (JP) ..... 2013-040510

(51) Int. Cl.
*H05B 41/36* (2006.01)
*H05B 37/02* (2006.01)
*H05B 41/04* (2006.01)

(52) U.S. Cl.
CPC ..... *H05B 41/042* (2013.01); *Y10S 315/07* (2013.01)

(58) Field of Classification Search
CPC .... H05B 37/02; H05B 41/2985; H05B 41/36; H05B 41/298; H05B 41/2851; H05B 41/2853; H05B 41/2923; H05B 41/2936
USPC ..... 315/119, 209 R, 224, 225, 246, 247, 315/291, 307, 308, 360, DIG. 5, DIG. 7
See application file for complete search history.

(56) References Cited

U.S. PATENT DOCUMENTS

| | | | | |
|---|---|---|---|---|
| 6,949,885 | B2 * | 9/2005 | Hamamoto et al. | 315/200 R |
| 7,276,862 | B2 * | 10/2007 | Kim et al. | 315/291 |
| 7,436,123 | B2 * | 10/2008 | Hamamoto et al. | 315/219 |
| 2010/0001650 | A1 * | 1/2010 | Hamana et al. | 315/119 |

FOREIGN PATENT DOCUMENTS

JP 2004-311199 4/2004

* cited by examiner

*Primary Examiner* — Douglas W Owens
*Assistant Examiner* — Thai Pham
(74) *Attorney, Agent, or Firm* — Duane Morris LLP; Joseph A. Powers

(57) ABSTRACT

A power supply circuit (4) is responsive to an activating signal by supplying a discharge lamp (2) with an operating voltage on which a high voltage is temporality superposed. An insufficient current detecting circuit (46) detects abnormality of an output current supplied to the discharge lamp (2) from the power supply circuit (4). A CPU (52) stops the operation of the power supply circuit (4) in response to detection of abnormality by the insufficient current detecting circuit (46). An output nullification time period timer (50) nullifies the output of the insufficient current detecting circuit (46) for a predetermined time period measured from the supplying of the activating signal.

4 Claims, 7 Drawing Sheets

Output Nullification
Period

Insufficient
Reference Current

Output Nullification
Period

Insufficient
Reference Current

Output
Nullification
Period

Insufficient
Reference Current

Output
Nullification
Period

Insufficient
Reference Current

DISCHARGE LAMP IGNITING APPARATUS

TECHNICAL FIELD

This invention relates to a discharge lamp igniting apparatus to turn on a discharge lamp.

BACKGROUND ART

An example of a discharge lamp igniting apparatus is disclosed in Japanese Patent Application Publication JP2004-311199A. According to the technology disclosed in this publication, abnormal arcing of a discharge lamp is detected on the basis of a current flowing through the lamp and a voltage applied to the lamp.

According to the above-cited publication, it is abnormal arcing that is detected. However, a possible different technique can be thought of. According to such different technique, the technique of detecting a current through the discharge lamp disclosed in this publication is used to determine that abnormality has been detected when the current flowing through the discharge lamp decreases below a predetermined reference current, and the power supply to the discharge lamp is interrupted to thereby turn off the lamp. When the lamp's operation is unstable in the initial operating state, the current flowing through the lamp is below the predetermined reference current. According to this technique, such state could be judged to be an abnormal state although the discharge lamp has not been turned on yet, to thereby undesirably disrupt the supply of power to the lamp. Then, according to this technique, it would be very frequent that the lamp is not turned on.

An object of the present invention is to provide a discharge lamp igniting apparatus with reduced ignition failures.

SUMMARY OF INVENTION

According to one embodiment of the present invention, a discharge lamp igniting apparatus includes power supply means. In response to an activating signal, the power supply means provides a discharge lamp with an operating voltage on which a high voltage is temporarily superposed thereon. Abnormality detecting means detects abnormality in an output supplied by the power supply means to the discharge lamp. The abnormality in the output supplied to the discharge lamp may be abnormality of at least one of the output voltage and output current of the power supply means, for example. In response to the abnormality detection made by the abnormality detecting means, control means stops the power supply means from operating. Output nullifying means nullifies the output of the abnormality detecting means for a predetermined time beginning from the supplying of the activating signal.

With the above-described arrangement of the discharge lamp igniting apparatus, even when the abnormality detecting means detects abnormality in the predetermined time, the power supply means is never disabled. Thus, when the discharge lamp is in the initial stage of the operation during which the lamp may be unstable, the supply of power to the discharge lamp is never interrupted improperly. Since the abnormality detecting means is enabled when the predetermined time period lapses, even if the discharge lamp is not operating normal, such abnormality is detected by the abnormality detecting means as soon as it is enabled, and, therefore, the power supply for the discharge lamp is interrupted. Further, if abnormality happens in the discharge lamp after the predetermined time period lapses, such abnormality can be detected by the abnormality detecting means as soon as the abnormality happens, and the power supply to the discharge lamp is interrupted.

The abnormality detecting means may include current detecting means that develops an abnormality indicative signal when the output current supplied from the power supply means to the discharge lamp is smaller than a predetermined value. In this case, during the predetermined time period, when the current detecting means develops the abnormality indicative signal first time and develops the abnormality indicative signal again after the first abnormality indicative signal disappears, the power supply means operates to superpose the high voltage on the operating voltage again.

With this arrangement, even when the ignition of the discharge lamp is unsuccessful during the predetermined time period, the superposing of the high voltage is done again, and, therefore, the possibility that the discharge lamp is ignited successfully increases.

In addition, counting means for counting the number of times the high voltage is superposed on the operating voltage may be used. In this case, when the count from the counting mean increases above a predetermined number, the power supply means is stopped.

With this arrangement, if the discharge lamp is ignited successfully even after the high-voltage superposition is repeated the predetermined number of times, the discharge lamp may be judged to have broken down, and the power supply to the discharge lamp is interrupted.

In the described embodiment, the output nullifying means may be a timer that measures the predetermined time period.

Further, altering means for altering the predetermined time period may be used with the timer.

Let it be assumed, for example, that as the remaining life of the discharge lamp becomes short, causing the time necessary for the lamp to be ignited to become longer. Under such circumstances, if the nullification of the output of the abnormality detecting means is stopped when the predetermined time period lapses, it is judged that the discharge lamp fails to operate properly, causing the power supply to the lamp to be stopped. By lengthening the predetermined time period in the timer by the altering means, the possibility that the discharge lamp can be properly ignited can be increased.

DESCRIPTION OF EMBODIMENTS

Figure 1:
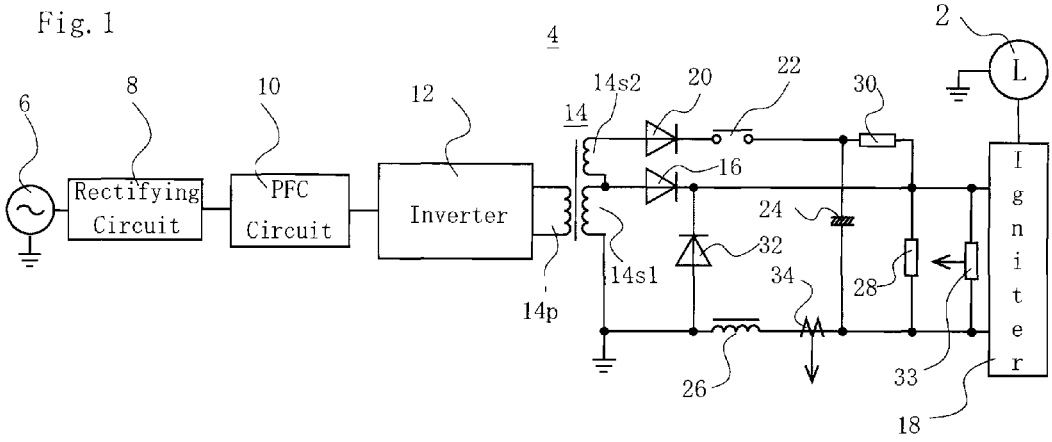
FIG. 1 is a block diagram of a discharge lamp igniting apparatus according to one embodiment of the invention.

A discharge lamp igniting apparatus according to one embodiment of the present invention is used to activate or ignite a discharge lamp (L) 2 of a projector, for example, and includes power supply means, e.g. a power supply circuit 4, as shown in FIG. 1. The power supply circuit 4 rectifies an AC voltage from a commercial AC power supply 6 in a rectifying circuit 8, improves the power factor of the rectifier output in a power factor correction (PFC) circuit 10, converts the power-factor corrected output to a high-frequency voltage in an inverter 12, and applies the high-frequency voltage to a primary winding 14*p* of a voltage transformer 14.

The transformer 14 has two secondary windings 14*s*1 and 14*s*2. The secondary winding 14*s*1 has its first end connected to a point of reference potential, e.g. ground potential, and has its second end connected to the anode of a diode 16. The rectified voltage developed between the cathode of the diode 16 and a first end of the secondary winding 14*s*1 is applied to one end of the discharge lamp 2 via an igniter circuit 18. A second end of the discharge lamp 2 is grounded.

The secondary winding 14*s*2 has its first end connected to the second end of the secondary winding 14*s*1 and has its second end connected to a first end of a capacitor 24 through a series combination of a diode 20 and high-voltage superposition switching means, e.g. a relay (RY) contact 22. A second end of the capacitor 24 is connected to the first end of the secondary winding 14*s*1 through a reactor 26. When the relay contact 22 is closed, a high-frequency voltage developed across the series combination of the secondary winding 14*s*1 and 14*s*2 is rectified by the diode 20. The resulting rectified voltage is larger than the rectified voltage developed between the cathode of the diode 16 and the first end of the secondary winding 14*s*1. The two rectified voltages are superposed on each other through a resistor 28 connected between the cathode of the diode 16 and the first end of the secondary winding 14*s*1 and a resistor 30 connected between the cathode of the diode 16 and the first end of the capacitor 24, and the thus superposed voltages are applied through the igniter circuit 18 to the discharge lamp 2. A diode 32 has its anode connected to the junction between the reactor 26 and the secondary winding 14*s*1, and has its cathode connected to the junction between the diode 16 and the resistor 28 so that the current flowing due to the counter electromotive force generated in the reactor 26 when the relay contact 22 is opened can circulate. In this way, the inverter 12, the transformer 14, the diodes 16, 20, and 32, the relay contact 22, the capacitor 24, the reactor 26, the resistors 28 and 30, and the igniter circuit 18 form a DC-to-DC converter.

The inverter 12 has a plurality of semiconductor switching devices, e.g. IGBTs or MOSFETs, which are ON-OFF controlled to generate a high-frequency voltage. For controlling these semiconductor switching devices and for controlling the relay contact 22, a voltage detector 33 detects the voltage across the resistor 28, which is the output voltage of the power supply circuit 4. The voltage detector 33 develops an output voltage representative signal. An output current from the power supply circuit 4 is detected by a current transformer 34 connected in series with the reactor 26, and the current transformer 34 develops an output current representative signal.

Figure 2:
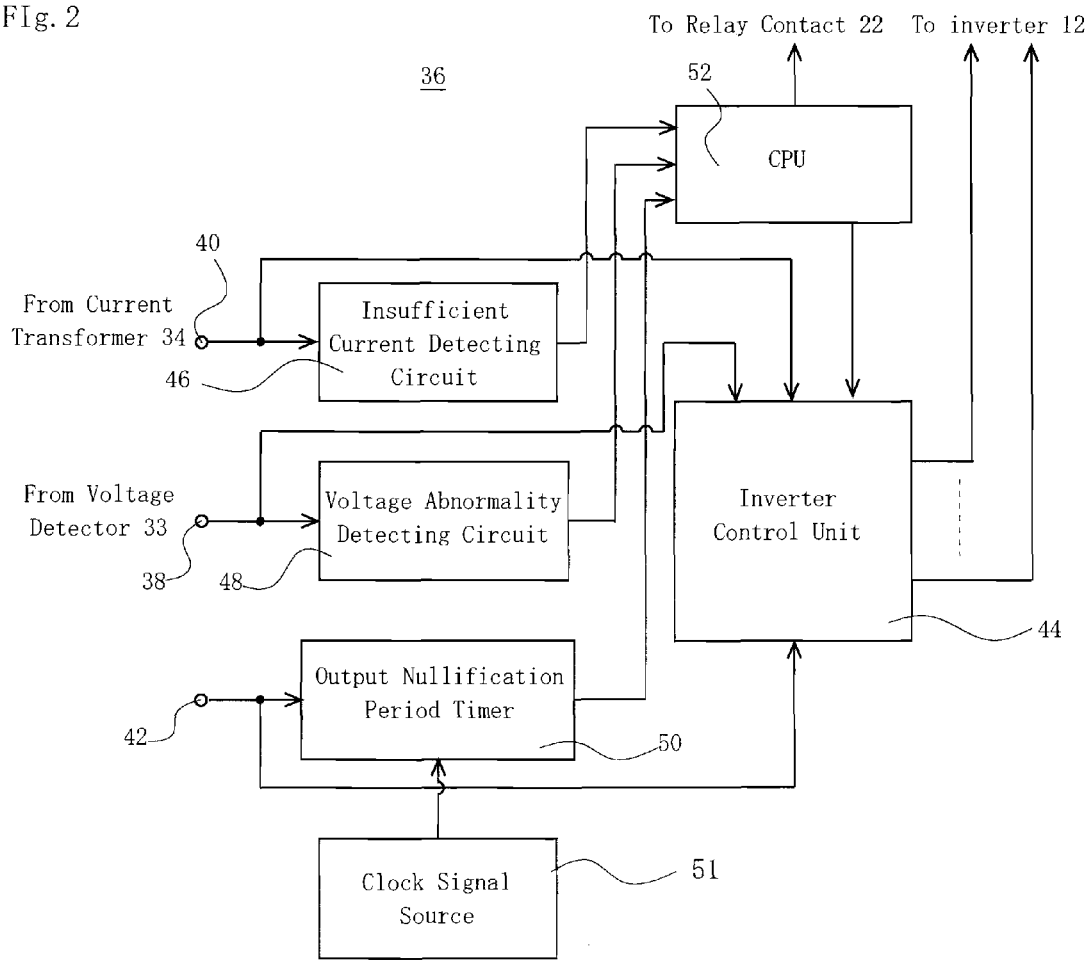
FIG. 2 is a block diagram of a control circuit for use with the discharge lamp igniting apparatus of FIG. 1.

The output voltage representative signal from the voltage detector 33 is applied to an input terminal 38 of control means, e.g. a controller 36 as shown in FIG. 2. The output current representative signal from the current transformer 34 is applied to an input terminal 40 of the controller 36. An input terminal 42 of the controller 36 receives a lamp-on signal to command the controller 36 to turn on the discharge lamp 2. The lamp-on signal is generated when a user of a projector, for example, in which the discharge lamp 2 is installed turns on a switch of the projector. The output voltage representative signal, the output current representative signal and the lamp-on signal are applied to an inverter control unit 44. The inverter control unit 44 supplies an inverter signal to the inverter 12 for ON-OFF controlling the respective semiconductor switching devices of the inverter 12 in accordance with the output voltage representative signal and the output current representative signal while the lamp-on signal is being supplied to the inverter control unit 44.

The output current representative signal coupled to the input terminal 40 is also applied to abnormality detecting means, e.g. an insufficient current detecting circuit 46. The insufficient current detecting circuit 46 develops an insufficient current representative signal when the output current representative signal is smaller than an insufficient current reference value signal corresponding to a predetermined insufficient current reference value. The output voltage representative signal coupled to the input terminal 38 is also applied to abnormality detecting means, e.g. a voltage abnormality detecting circuit 48. The voltage abnormality detecting circuit 48 develops an abnormal voltage representative signal when the output voltage representative signal is larger than an excessive voltage reference signal corresponding to a predetermined excessive voltage or smaller than an insufficient voltage reference signal corresponding to a predetermined insufficient voltage.

The lamp-on signal coupled to the input terminal 42 is also coupled to output nullifying means, e.g. an output nullification time period timer 50 for measuring the time period during which the output of the voltage abnormality detecting circuit 48 and the output of the insufficient current detecting circuit 46 are nullified. The output nullification time period timer 50 starts counting a clock signal from a clock signal source 51 in response to the rising of the lamp-on signal and provides an output nullifying signal until it counts the number of clock signals corresponding to a predetermined output nullification time period.

The insufficient current representative signal, the abnormal voltage representative signal and the output nullifying signal are coupled to a CPU 52, for example. The CPU 52 controls the relay contact 22 and the inverter control unit 44 in accordance with the insufficient current representative signal, the abnormal voltage representative signal and the output nullifying signal, in a manner shown in FIGS. 3*a* through 6*f*. The following descriptions of the control operation are based on an assumption that, initially, the relay contact 22 is closed, the inverter 12 is not operating and the insufficient current representative signal is generated.

Figures 3A, 3B, 3C, 3D, 3E, 3F:
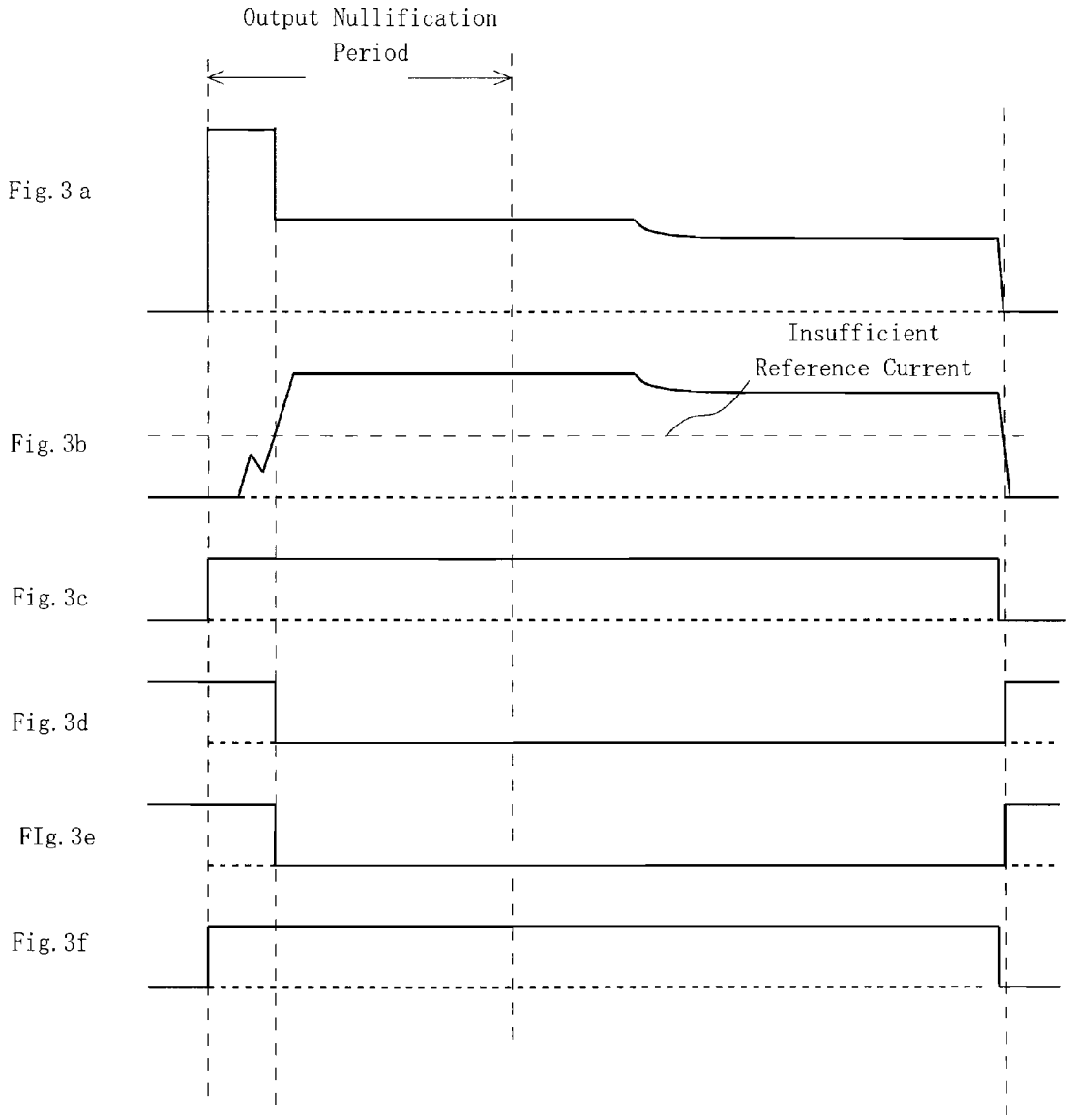
FIGS. 3*a* through 3*f* are waveforms appearing at various points of the igniting apparatus of FIG. 1 when a discharge lamp is ignited properly.

FIGS. 3*a* through 3*f* show waveforms appearing at various portions of the discharge lamp igniting apparatus when the discharge lamp 2 is properly ignited in response to the supply of the lamp-on signal. Upon application of the lamp-on signal as shown in FIG. 3*c*, the inverter signal is applied to the inverter 12 from the inverter control unit 44 as shown in FIG. 3*f*, causing the inverter 12 to generate a high-frequency voltage. Since the relay contact 22 is closed, the output voltage that initially contains the high voltage superposed thereon is applied to the discharge lamp 2 for the purpose of igniting the discharge lamp 2, as shown in FIG. 3*a*. This causes the output current to start rising as shown in FIG. 3*b*. While this output current is equal to or smaller than the insufficient current reference signal, the insufficient current detecting circuit 46 supplies the insufficient current representative signal to the CPU 52 as shown in FIG. 3*d*. However, since the output nullification time period has not lapsed yet, the output nullification time period timer 50 is supplying the output nullifying signal to the CPU 52. As a result, the CPU 52 does not supply the disabling signal to the inverter control unit 44, and the inverter 22 continues operating. Soon the output current becomes larger than the insufficient current reference value as shown in FIG. 3*b*, and, then, the discharge lamp 2 starts lighting. Then, as shown in FIG. 3*d*, the insufficient current representative signal disappears, and the CPU 52 opens the relay contact 22 as shown in FIG. 3*e*, resulting in interruption of superposition of the high voltage as shown in FIG. 3*a*.

Let it be assumed that the discharge lamp 2 is kept emitting light properly after the output nullification time period has lapsed. Then, the lamp-on signal is interrupted as shown in FIG. 3*c*, causing the CPU 52 to make the inverter control unit 44 stop generating the inverter signal. As a result, as shown in FIG. 3*a*, the output voltage decreases and the output current becomes smaller than the insufficient reference current as shown in FIG. 3*b*. Then, the insufficient current detection signal is generated and the CPU 52 causes the relay contact 22 to be closed.

As described, although an insufficient current flows until the discharge lamp 2 is ignited even during the output nullification time period, the abnormality detection is nullified and, therefore, the inverter 12 is not disabled.

Figures 4A, 4B, 4C, 4D, 4E, 4F:
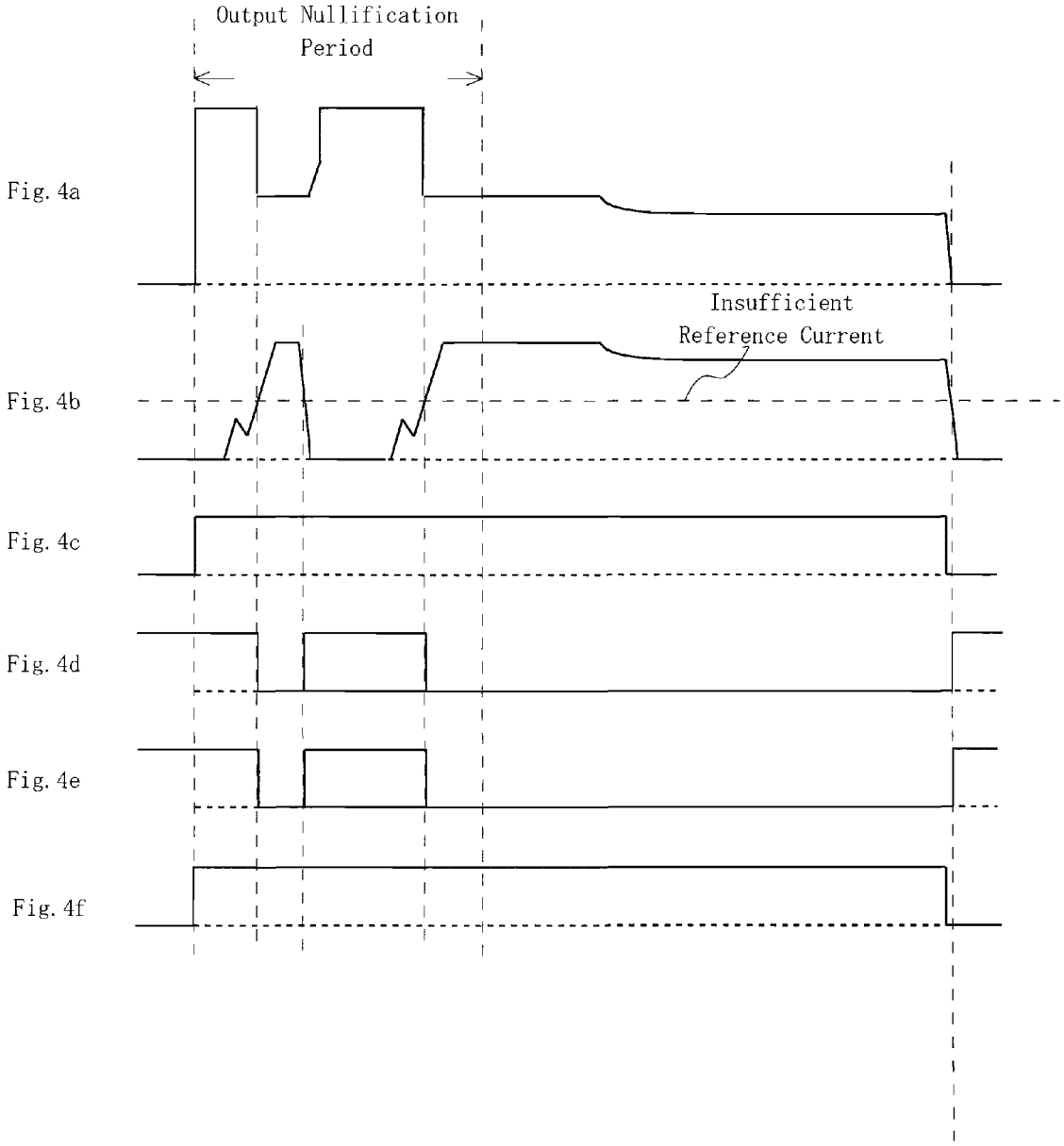
FIGS. 4*a* through 4*f* are waveforms appearing at various points of the igniting apparatus of FIG. 1 when the discharge lamp fails to be ignited once and then ignited again.

FIGS. 4*a* through 4*f* are waveforms appearing at various portions of the discharge lamp igniting apparatus in such a case that the discharge lamp 2 is ignited in response to the application of the lamp-on signal, and that the lamp 2, however, is not properly ignited and, accordingly, ignition is tried again even in the output nullification time period. The operation performed until the output current exceeds the insufficient reference current and the relay contact 22 is opened is the same as the one shown in FIGS. 3*a* through 3*f* in which the discharge lamp is properly ignited. However, in the case of FIGS. 4*a* through 4*f*, the ignition is not properly done, the output current decreases below the insufficient current reference value as shown in FIG. 4*b*, and the insufficient current detecting circuit 46 outputs the insufficient current representative signal as shown in FIG. 4*c*. As a result, the relay contact 22 is closed again as shown in FIG. 4*e*, and the high voltage is superposed again on the output voltage as shown in FIG. 4*a*, resulting in retrial of the ignition. This causes the output current to increase above the insufficient reference current as shown in FIG. 4*b*. As a result, the insufficient current representative signal disappears as shown in FIG. 4*d*, and the relay contact 22 is opened.

Like this, even during the output nullification time period, if the ignition of the discharge lamp 2 fails, the disabling of the operation of the inverter 12 does not take place and the ignition of the discharge lamp 2 is tried again while the insufficient current representative signal is developed. If the retrial of the ignition of the discharge lamp 2 fails again, the ignition is further tried.

Figures 5A, 5B, 5C, 5D, 5E, 5F:
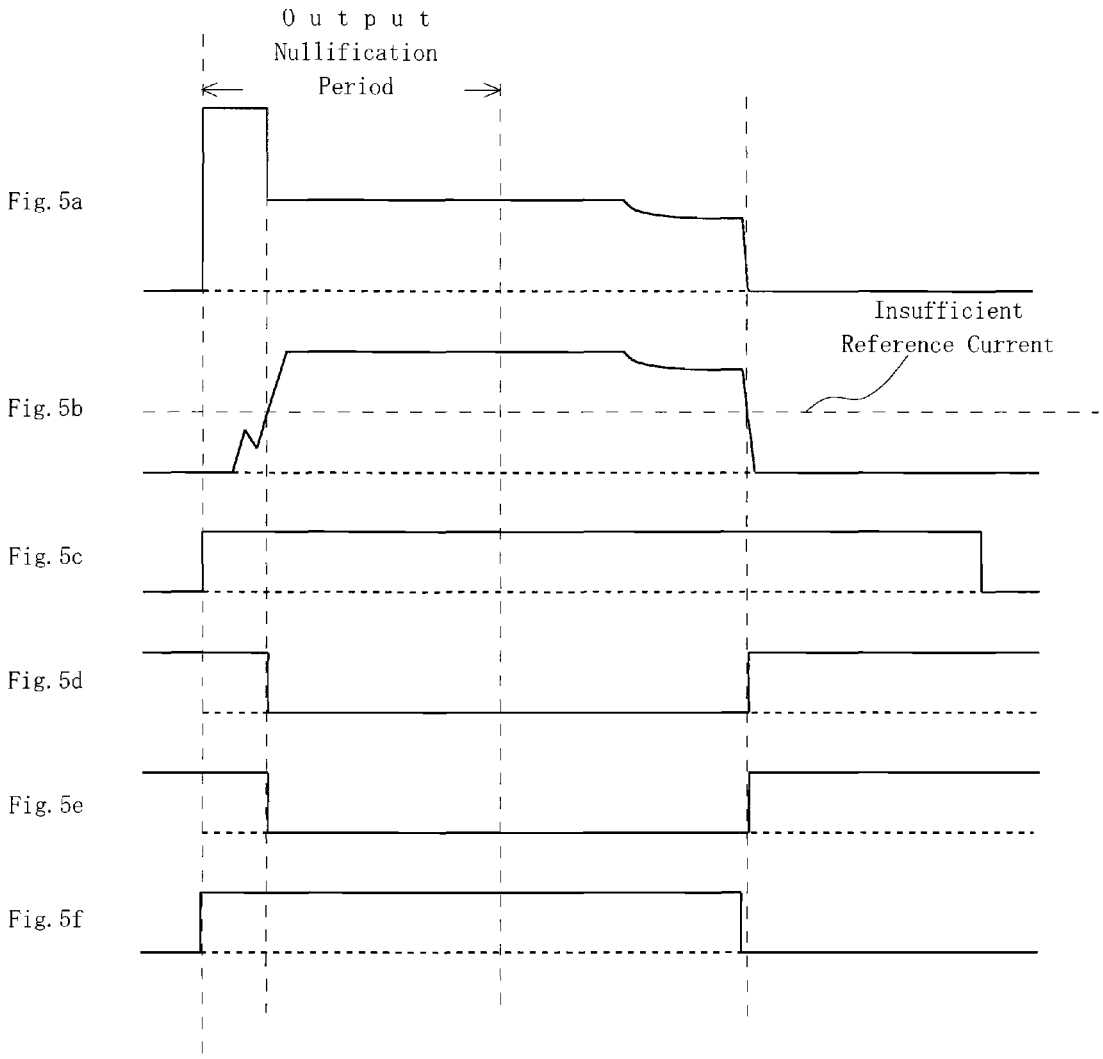
FIGS. 5*a* through 5*f* are waveforms appearing at various points of the igniting apparatus of FIG. 1 when the discharge lamp is properly ignited and failure or abnormality is detected after an output nullification time period has lapsed.

FIGS. 5*a* through 5*f* are waveforms at various portions of the discharge lamp igniting apparatus appearing when the discharge lamp 2 is properly ignited, but the output current decreases below the insufficient reference current after the nullification time period lapses. The operation before the nullification time period lapses is the same as the operation shown in FIGS. 3*a* through 3*f* where the discharge lamp 2 is ignited properly. When the output current decreases below the insufficient reference current for some reason after the nullification time period lapses as shown in FIG. 5*b*, the insufficient current representative signal is generated as shown in FIG. 5*d*, and the CPU 52 interrupts the inverter signal as shown in FIG. 5*f*. This causes the supply of the output voltage to the discharge lamp 2 to be stopped as shown in FIG. 5*a*. The CPU 52 then provides for the next ignition of the discharge lamp 2. It should be noted that, although not shown, separate from abnormality of the output current, if the output voltage increases above the excessive reference voltage or below the insufficient reference voltage, the voltage abnormality detecting circuit 48 supplies the abnormal voltage representative signal to the CPU 52, and the CPU 52 interrupts the inverter signal to thereby close the relay contact 22 as in the above-described manner.

Like this, if any improper operation takes place after the nullification time period lapses, the inverter 12 is disabled and the relay contact 22 is closed.

Figures 6A, 6B, 6C, 6D, 6E, 6F:
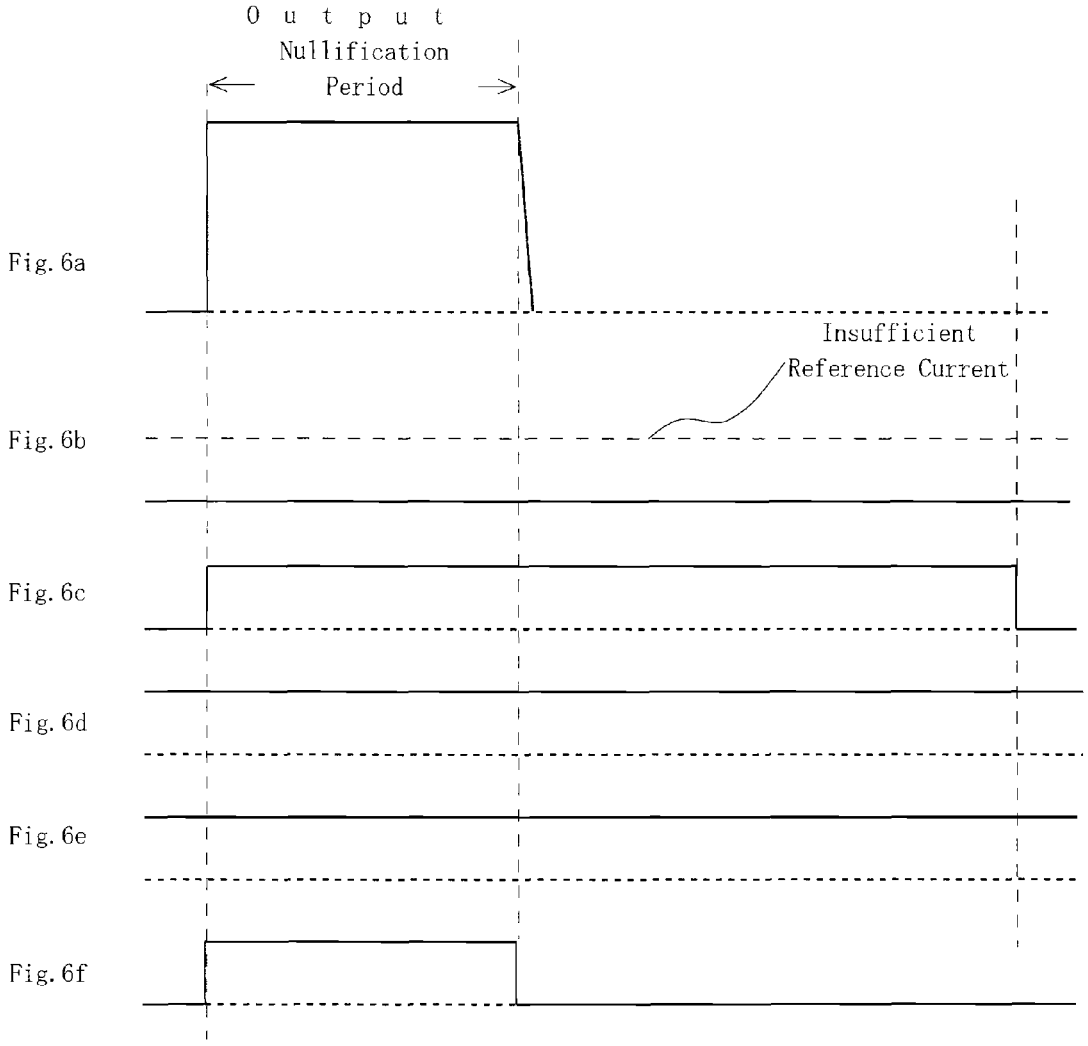
FIGS. 6*a* through 6*f* are waveforms appearing at various points of the igniting apparatus of FIG. 1 when the discharge lamp is not ignited during the abnormality detecting time period and abnormality is detected immediately after the output nullification time period has lapsed.

FIGS. 6*a* through 6*f* are waveforms at various portions of the discharge lamp igniting apparatus appearing when the discharge lamp 2 is failed to be ignited. Even though the lamp-on signal is supplied as shown in FIG. 6*c*, with the inverter signal being applied to the inverter 12 as shown in FIG. 6*f*, with the relay contact 22 being closed as shown in FIG. 6*e*, and with the output voltage on which the high voltage is superposed being supplied to the discharge lamp 2 as shown in FIG. 6*a*, if the discharge lamp 2 is not ignited because the output current is smaller than the insufficient reference current, causing the insufficient current representative signal to be generated as shown in FIG. 6*d*, the CPU 52 continues to supply the inverter signal during the output nullification time period. However, as soon as the output nullification time period lapses, the CPU 52 stops the inverter signal as shown in FIG. 6*f* to stop the operation of the inverter 12. It should be noted that the relay contact 22 is kept closed even after the operation of the inverter 12 is stopped.

Like this, when the ignition of the discharge lamp 2 fails, the inverter 12 is stopped as soon as the output nullification time period is over.

Figure 7:
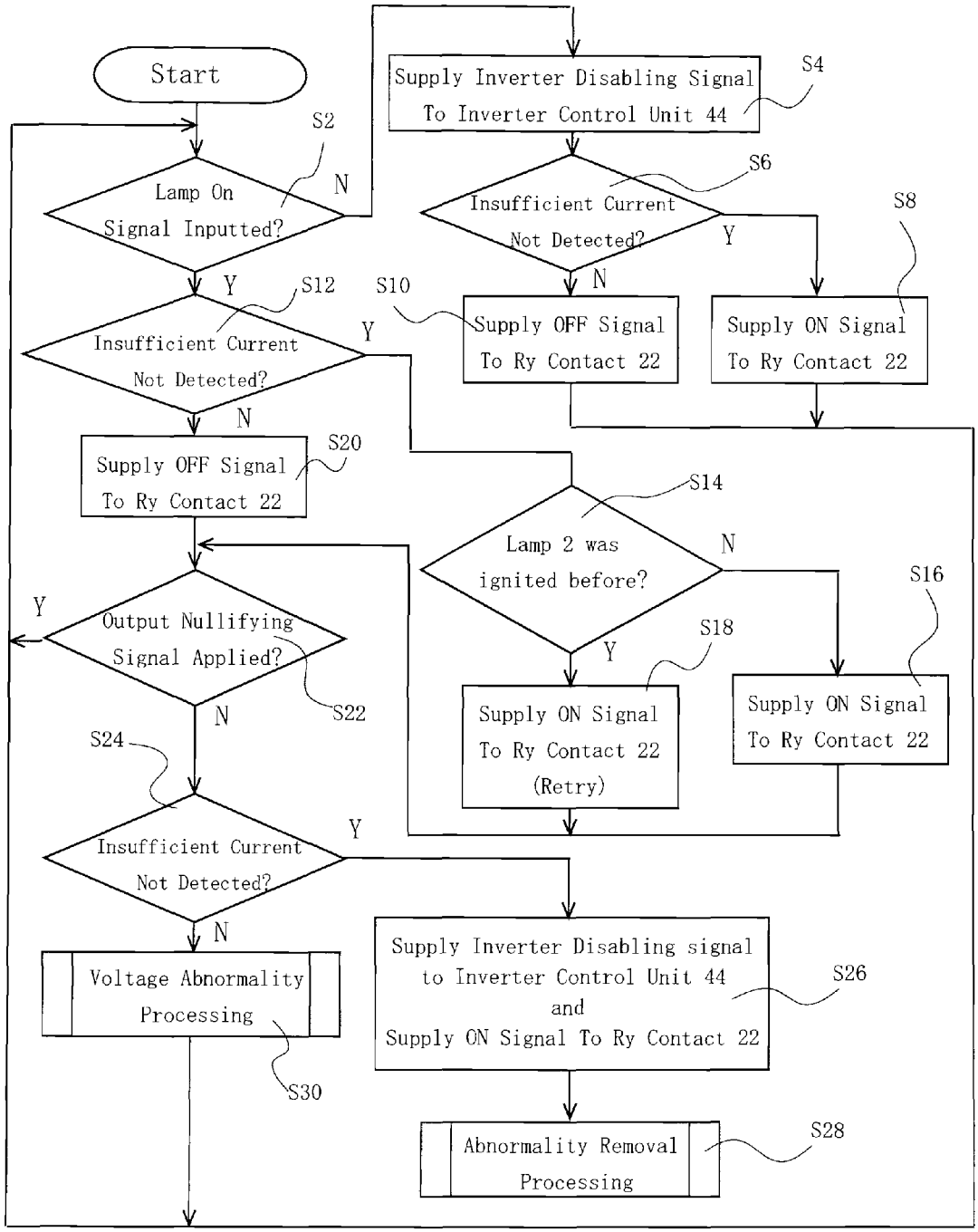
FIG. 7 is a flow chart of the processing performed by a CPU 52 of FIG. 2.

To achieve the above-described operations, the CPU 52 performs processing as shown in FIG. 7. First, the CPU 52 judges whether the lamp-on signal is inputted or not (Step S2). If the answer to this query is NO, the CPU 52 supplies an inverter disabling signal to the inverter control unit 44 (Step S4). This makes the inverter control unit 44 not provide an inverter signal, to thereby disable the inverter 12. Then, the CPU 52 judges whether an insufficient current is not detected (Step S6). In other words, the CPU 52 makes a judgment as to if the insufficient current representative signal is not being applied to the CPU 52. If the answer to this query is YES, i.e. if an insufficient current is detected, the CPU 52 supplies the ON signal to the relay contact 22 to close it (Step S8) and executes Step S2 again. If the answer to the query made in Step S6 is NO, i.e. if an insufficient current is not detected, the CPU 52 supplies the OFF signal to the relay contact 22 to open it (Step S10) and execute Step S2 again.

If the answer to the query in Step S2 is YES, i.e. if a command to ignite the discharge lamp 2 is supplied to the CPU 52, the inverter signal is applied to the inverter 12 from the inverter control unit 44 since the lamp-on signal is also applied to the inverter control unit 44. If the answer to the query in Step S2 is YES, the CPU makes a judgment as to if an insufficient current has not been detected yet (Step S12). If the answer is YES, i.e. if an insufficient current is detected, the CPU 52 makes a judgment as to if the discharge lamp 2 was ignited before (Step S14). This judgment is made by, for example, determining whether the insufficient current representative signal has ever been developed or not.

If the insufficient current representative signal was not developed before and if it is judged in Step S12 that the insufficient current representative signal is developed, meaning that the discharge lamp 2 has not ever been ignited, the answer to the query in Step S14 is NO. If the insufficient current representative signal is developed in Step S12 while the insufficient current representative signal was developed before, meaning that, although the discharge lamp 2 has been ignited, the ignition is imperfect, the answer to the query in Step S14 is YES.

If the answer to the query made in Step S14 is NO, the CPU 52 supplies the relay contact 22 with the ON signal for the first ignition (Step S16). If the answer to the query in Step 14 is YES, the CPU 52 supplies the relay contact 22 with the ON signal for the retrial of the ignition (Step S18).

If the answer to the query made in Step S12 is NO, i.e. if it is judged that an output current larger than the insufficient reference current is flowing, the CPU 52 supplies the OFF signal to the relay contact 22 (Step S20), whereby the superposing of the high voltage onto the output voltage is interrupted.

Following Step S16, S18 or S20, the CPU 52 makes a judgment as to whether the output nullifying signal is supplied to the CPU 52 from the output nullification time period timer 50 (Step S22). If the answer to this query is YES, meaning that the output nullification time period has not yet lapsed, the CPU 52 executes Step S2 again. In other words, if an insufficient current is detected during the output nullification time period after the inputting of the lamp-on signal, the inverter 12 is not disabled although the ON signal is supplied to the relay contact 22, and the lamp igniting apparatus operates as in the output nullification time period in FIGS. 3*a* through 3*f*, FIGS. 4*a* through 4*f*, FIGS. 5*a* through 5*f*, or FIGS. 6*a* through 6*f*.

If the answer to the query made in Step S22 is NO, meaning that the output nullification time period has lapsed, the CPU 52 starts detecting abnormality in the steady state operation of the apparatus. In other words, the CPU 52 makes a judgment as to if an insufficient current is not detected (Step S24). If the answer to this query is YES, the CPU 52 supplies the inverter disabling signal to the inverter control unit 44 to stop the operation of the inverter 12, and also supplies the ON signal to the relay contact 22 (Step S26). This makes the discharge lamp igniting apparatus operate in the manner after the lapse of the nullification time period shown in FIGS. 5*a* through 5*f* or FIGS. 6*a* through 6*f*. It should be noted that, in this case, the CPU 52 may be arranged to send a lamp failure indicative alert signal to the projector. After that, the CPU 52 executes an abnormality removing processing until the abnormality is removed (Step S28).

If the answer to the query made in Step S24 is NO, the CPU 52 executes a voltage abnormality processing (Step S30). In this processing, the CPU 52 makes a judgment as to if the abnormal voltage representative signal is supplied to the CPU 52, and, if not, Step S2 is executed. If the abnormal voltage representative signal is supplied to the CPU 52, the CPU 52 supplies the inverter disabling signal to the inverter control unit 44 to stop the operation of the inverter 12 and also close the relay contact 22. Then, an abnormality removal processing similar to the above-described one is executed.

If the answer to the query made in Step S22 is YES, meaning that the output nullification time period has not yet lapsed, the CPU 52 executes the processing beginning from Step S2 again.

Figure 8:
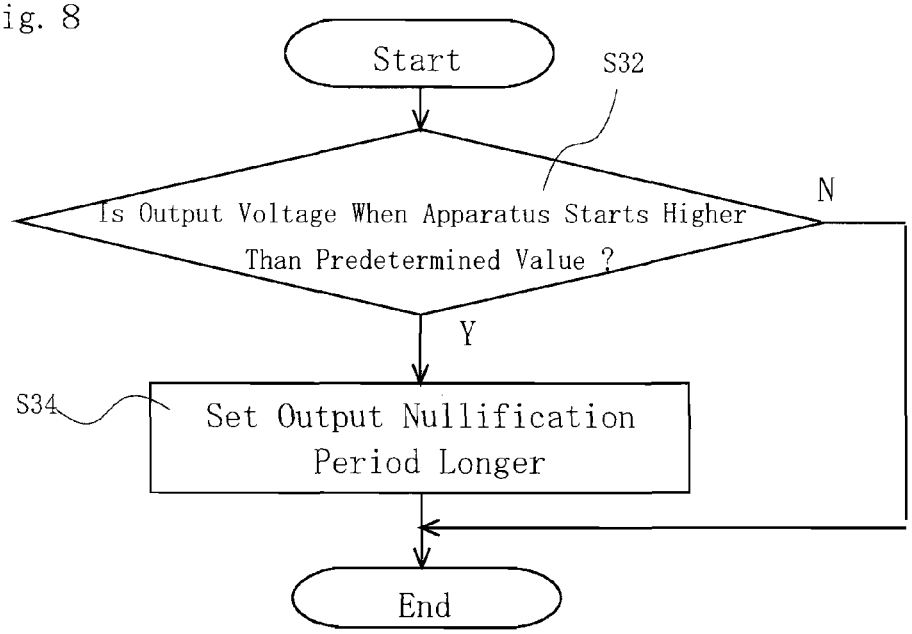
FIG. 8 shows part of a modification of the processing performed by the CPU 52 of FIG. 2.

In the described embodiment, the output nullification time period is a fixed period, but it may be changeable depending on the condition of a discharge lamp 2. For example, if the remaining life of the discharge lamp 2 being used is short, a high output voltage is developed when the discharge lamp 2 is activated. This high output voltage developed at the time of activation is supplied to the CPU 52 from the voltage detector 38 beforehand, and the CPU 52 judges whether the output voltage developed when the apparatus starts operating is higher than a predetermined value as shown in FIG. 8 (Step S32). If the answer to the query made in Step 32 is YES, the output nullification time period is made longer than before by, for example, a predetermined amount (Step S34). This procedure may be used as altering means for altering the output nullification time period set in the output nullification time period timer 50.

Figure 9:
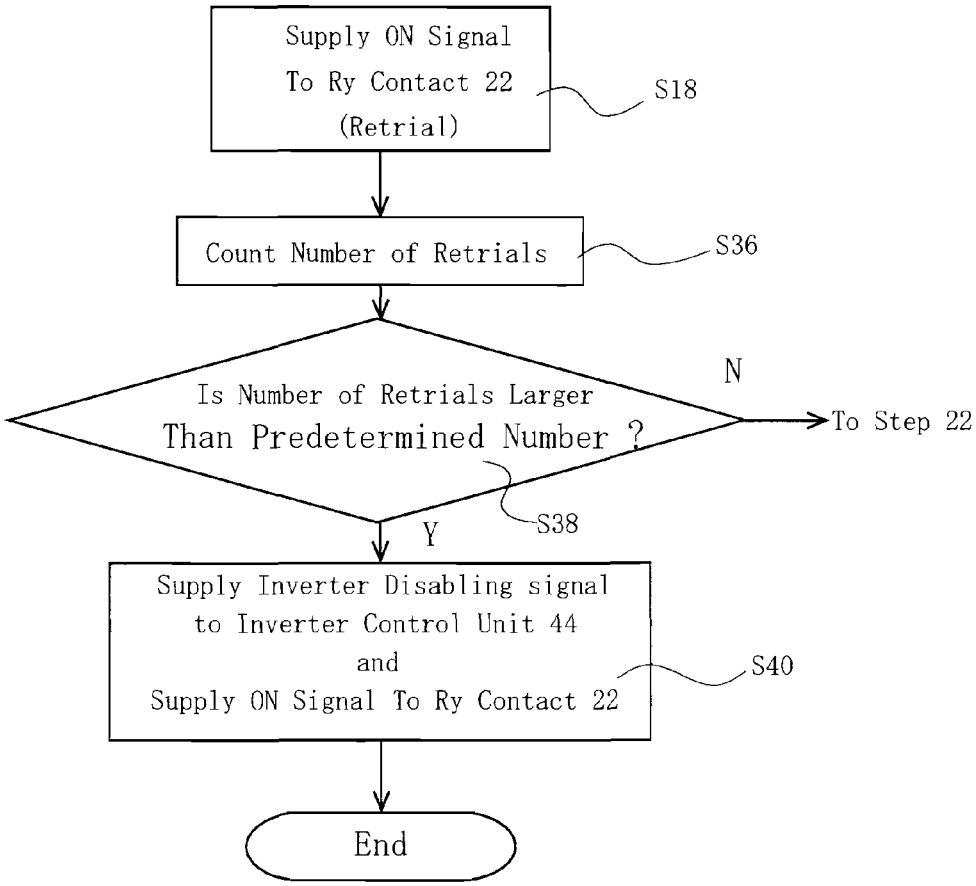
FIG. 9 shows part of another modification of the processing performed by the CPU 52 of FIG. 2.

In the described embodiment, Step S22 is executed after the ignition of the lamp 2 is retried in Step S18, but it may be arranged as shown in FIG. 9 that, after the execution of Step S18, the CPU 52 counts the number of the retrials done (Step S36), the CPU 52 makes a judgment as to whether the number of the retrials done is larger than a predetermined number of the retrials (Step S38), the CPU 52 executes Step S22 if the answer to the query made in Step S38 is NO, and, if the answer is YES, the CPU 52 supplies the inverter disabling signal to the inverter control unit 44 to make the inverter 12 stop operating and supplies the ON signal to the relay contact 22 (Step S40). With this arrangement, if the discharge lamp 2 is not lighted even after the predetermined number of the retrials of ignition, it can be judged that the discharge lamp 2 is broken down, and the operation of the discharge lamp igniting apparatus is stopped.

In the described embodiment, both the insufficient current detecting circuit 46 and the voltage abnormality detecting circuit 48 are used as the abnormality detecting means, but either one of them only may be used as the abnormality detecting means. The voltage abnormality detecting circuit 48 is described to detect both an excessive output voltage and an insufficient output voltage, but it may be arranged to detect only either one of the excessive and insufficient output voltages. Further, in the described embodiment, the insufficient current detecting circuit 46, the voltage abnormality detecting circuit 48 and the output nullification time period timer 50 are components separate from the CPU 52, but it may be arranged such that the functions of the insufficient current detecting circuit 46, the voltage abnormality detecting circuit 48 and the output nullification time period timer 50 are performed by the CPU 52, removing the insufficient current detecting circuit 46, the voltage abnormality detecting circuit 48 and the output nullification time period timer 50.

The invention claimed is:

1. A discharge lamp igniting apparatus comprising:

DC power supply means responsive to application thereto of an ON signal to command turning-on of a discharge lamp, for supplying said discharge lamp with a high voltage formed by temporarily superposing a DC superposition voltage on a DC operating voltage, and, after the temporary superposition of said DC superposition voltage, applying said DC operating voltage to said discharge lamp, said discharge lamp being such that current equal to or larger than a predetermined reference current flows when said discharge lamp is ignited successfully;

current detecting means for detecting the current flowing through said discharge lamp;

control means for stopping said DC power supply means when the current flowing through said discharge lamp as detected by said current detecting means is smaller than said reference current; and disabling means for disabling said control means for a predetermined time period from the time at which said ON signal is applied, said disabling means including a timer measuring said predetermined time period;

said predetermined time period being longer than a time period during which said high voltage is required to be supplied to said discharge lamp in order for said discharge lamp to be ignited successfully.

2. A discharge lamp igniting apparatus according to claim 1 further comprising altering means for altering said predetermined period.

3. A discharge lamp igniting apparatus according to claim 1 wherein:

said DC power supply means operates to supply again said high voltage to said discharge lamp when the current as detected by said current detecting means increases to or above said reference current and, then, decreases below said reference current during said predetermined time period.

4. A discharge lamp igniting apparatus according to claim 1 further comprising counting means for counting the number of times of superposing of said high voltage, the operation of said DC power supply means being stopped when the count in said counting means increases a predetermined count.

* * * * *

UNITED STATES PATENT AND TRADEMARK OFFICE

CERTIFICATE OF CORRECTION

PATENT NO. : 9,013,115 B2
APPLICATION NO. : 14/034047
DATED : April 21, 2015
INVENTOR(S) : Tatsuya Kawabata and Hiroki Morimoto It is certified that error appears in the above-identified patent and that said Letters Patent is hereby corrected as shown below:

In the Claims

Column 9, line 19 Claim 4 delete "1" and insert therefor --3--

Signed and Sealed this
Fourth Day of August, 2015

Michelle K. Lee

Michelle K. Lee
*Director of the United States Patent and Trademark Office*